US008085971B2

(12) United States Patent
Kam

(10) Patent No.: US 8,085,971 B2
(45) Date of Patent: Dec. 27, 2011

(54) MOVING-COIL PLANAR SPEAKER

(76) Inventor: Tai Yan Kam, Hsinchu (TW)

( * ) Notice: Subject to any disclaimer, the term of this patent is extended or adjusted under 35 U.S.C. 154(b) by 850 days.

(21) Appl. No.: 12/125,918

(22) Filed: May 23, 2008

(65) Prior Publication Data

US 2009/0290748 A1 Nov. 26, 2009

(51) Int. Cl.
*H04R 1/02* (2006.01)

(52) U.S. Cl. ..... 381/431; 181/172; 181/171

(58) Field of Classification Search ..... 381/399, 381/400, 431; 181/171, 172
See application file for complete search history.

(56) References Cited

U.S. PATENT DOCUMENTS

2009/0026007 A1* 1/2009 Corynen ..... 181/171
* cited by examiner

*Primary Examiner* — Charles Garber
*Assistant Examiner* — Reema Patel

(57) ABSTRACT

The planar speaker contains a frame, a diaphragm, a driver, a surround, and a number of flexible suspension elements. The diaphragm is suspended in a front opening of the frame by the surround. The driver is positioned at the center of the frame and a voice coil of the driver is attached to a back surface of the diaphragm. Two beams are arranged in parallel between two opposing longer wall segments of the frame on either side of the driver. The suspension elements are supported by the two beams, respectively, and attached to a back surface of the diaphragm. The symmetric deformation of the diaphragm along its longer side is thereby constrained by the suspension elements and the deformations at the two end zones of the diaphragm vibrating at a phase opposite to that of the center of the diaphragm would be suppressed.

9 Claims, 8 Drawing Sheets

MOVING-COIL PLANAR SPEAKER

BACKGROUND OF THE INVENTION

1. Field of the Invention

The present invention generally relates to loudspeakers, and more particularly to a moving-coil planar speaker.

2. Description of Related Art

As shown in FIGS. 1 and 2, a conventional moving-coil planar speaker usually contains a frame 1, a conepaper or diaphragm 2, a driver 3, and a surround 4. The frame 1 is basically has flat rectangular shape with a front opening. The frame 1 is mainly formed by a rectangular side wall 102 perpendicularly surrounding the circumference of a back wall 108. The side wall 102 is composed of a pair of opposing short wall segments 104 and a pair of opposing long wall segments 106. Assuming that the short wall segments 104 have a length a and the long wall segments 106 have a length b, then a is less or equal to b. The driver 3 is fixedly positioned at the center of the back wall 108 and is enclosed by the side wall 102. The surround 4 is a ring of flexible material (such as foam or rubber) that suspends the diaphragm 2 in the front opening of the frame 1, thereby sealing the driver 3 inside. The cross section of the surround 4 has an arc shape with an inner edge and an outer edge fixedly joined to the circumferences of the diaphragm 2 and the side wall 102, respectively. The diaphragm 2 therefore can freely vibrate in the front opening of the frame 1.

The driver 3 mainly contains a magnet set 302, a voice coil 304, an inner frame 306, and a spider 308. The magnet set 302 is fixedly housed inside the inner frame 306. The voice coil 304 has a front end fixedly attached to a back surface of the diaphragm 2 and is supported in a front opening of the inner frame 306 by the spider 308 which is a ring of flexible material. The magnet set 302 is threaded in a back end of the voice coil 304. The spider 308 holds the voice coil 304 in position, but allows it to move freely back and forth along its axis in the magnet field produced by the magnet set 302.

When electrical current is introduced through the voice coil 304, a electromagnetic field is produced to interact with the magnetic field produced by the magnet set 302. The interaction between the two magnetic fields causes the voice coil 304 to move back and forth along its axis. When the voice coil 304 moves, it pushes and pulls the diaphragm 2. The diaphragm 2 therefore vibrates the air in the front, thereby creating sound waves. As such, depending on how fast and how strong the diaphragm 2 vibrates, sounds of various frequencies and amplitudes are produced.

Generally, a speaker's performance in the low frequency range is measured by its dynamic range and bandwidth. Dynamic range is about the sound pressure produced by the speaker. If the diaphragm can drive more amount of air, the speaker then can produce a stronger sound pressure, thereby achieving a superior dynamic range and efficiency. Therefore, the dynamic range of a speaker is positively related to the piston area and displacement of the speaker's diaphragm. Among them, the displacement of the diaphragm (or the amplitude of the diaphragm's vibration) is determined by the magnetic force between the voice coil and the magnet set. Generally, greater dimensioned magnet set and voice coil imply that the driver is capable of driving the diaphragm to vibrate with greater amplitude and thereby producing a louder sound and a superior dynamic range.

On the other hand, the low-frequency bandwidth is directly affected by the sizes and flexibilities of the surround and spider. A spider with greater outer diameter is more flexible and the speaker would therefore have a broader low-frequency range. In contrast, a spider with a smaller outer diameter is more rigid. The speaker's frequency response is shifted towards the mid- and high-frequency ranges and the speaker thereby suffers a less satisfactory low-frequency performance.

When the short wall segments of a conventional planar speaker is reduced down to $a<b/2$, the low-frequency response of the speaker would deteriorate significantly. On one hand, if the spider's outer diameter is reduced to fit in the narrow frame, the flexibility of the spider would decrease and the low-frequency bandwidth of the speaker would be reduced as well. On the other hand, if the driver's outer diameter and the size of the magnet are reduced to maintain the original bandwidth, the driver wouldn't be able to exert enough driving force and the speaker's dynamic range would be seriously affected. In other words, conventional speaker design approaches are not appropriate for the elongated planar speaker. Moreover, when the diaphragm is driven to perform a back-and-forth movement under a middle frequency, the diaphragm would exhibit a symmetric deformation along the speaker's longer side. One such symmetric deformation, referred to as the first symmetric bending mode is shown in FIG. 3 in which the side view of the diaphragm shows that the area of the diaphragm contains two out-of-phase zones. There are other possible symmetric deformations where the area of the diaphragm is separated into more out-of-phase zones. As illustrated, the dashed line connecting the points i and j is referred to as the cross-over line and the points i and j are referred to as cross-over points. The cross-over line separates the area of the diaphragm into two zones, marked as A (center zone) and B (end zone) in FIG. 3. The two zones of the diaphragm, one in front of and the other one behind the cross-over line have a 180-degree phase difference. That is, when zone A moves in one direction, zone B moves in the other direction. The sound pressures produced by the two zones would interfere with and cancel each other. FIG. 4 illustrates the result of such cancellation. In FIG. 4, the vertical axis is the sound pressure level (SPL) and the horizontal axis is frequency. As illustrated, the sound pressure level has a sharp drop around 2 KHz. Such a sudden sound pressure drop in the middle-frequency range would seriously affect the reproduced sound quality of the speaker.

BRIEF SUMMARY OF THE INVENTION

Accordingly, a novel moving-coil planar speaker is provided herein to obviate the foregoing shortcomings of the prior art. The most significant characteristic of the present invention lies in the symmetric arrangement of suspension elements behind the diaphragm to prevent different portions of the diaphragm from entering into out-of-phase movement.

The planar speaker of the present invention contains a frame, a diaphragm, a driver, a surround, and a number of flexible suspension elements. The frame has a flat rectangular shape and the diaphragm is suspended in a front opening of the frame by the surround. The driver is positioned at the center of the frame and a voice coil of the driver is attached to a back surface of the diaphragm so that a back-and-forth movement of the voice coil would cause the diaphragm to vibrate and to produce sound waves.

The surround is made of a flexible material and is positioned between the circumference of the front opening of the frame and the edge of the diaphragm. The surround, on one hand, suppresses the vibration of the diaphragm at its edge and, on the other hand, prevents the sound waves at either side of the diaphragm from interfering with each other.

Two beams are arranged in parallel between two opposing longer wall segments of the frame and symmetrically at either side of the driver. The suspension elements are supported by the two beams, respectively, and attached to a back surface of the diaphragm. The diaphragm, under the balanced support of the suspension elements, would only undergo linear displacement which in turn confines the voice coil of the driver to engage linear movement only.

The suspension elements are made of a flexible element and contain a wave-like segment. The suspension elements therefore could vibrate with the diaphragm and, on the other hand, the first symmetric bending mode of the diaphragm along its longer side is also constrained by the suspension elements. The areas near the two ends of the diaphragm, which vibrates at a phase opposite to the central area of the diaphragm, would be reduced. The speaker therefore would enjoy a relatively flat frequency response in the middle-frequency range and a superior sound quality.

The locations where the suspension elements are attached to the diaphragm could not be right at the cross-over point but rather at either side of the cross-over point of the first symmetric bending mode of the diaphragm. The locations of the cross-over point could be determined by simulation and analysis.

The foregoing and other objects, features, aspects and advantages of the present invention will become better understood from a careful reading of a detailed description provided herein as given below with appropriate reference to the accompanying drawings.

DETAILED DESCRIPTION OF THE INVENTION

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
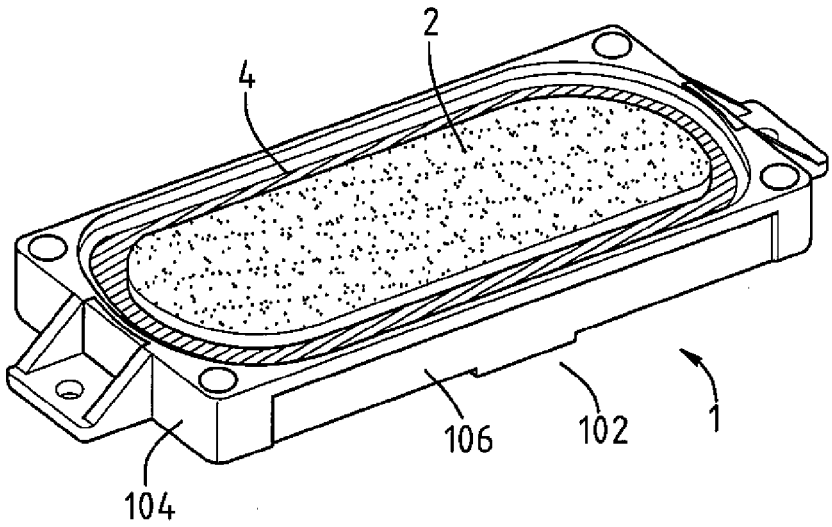
FIG. 1 (PRIOR ART)
FIG. 1 is a perspective diagram showing a conventional planar speaker.
Figure 2:
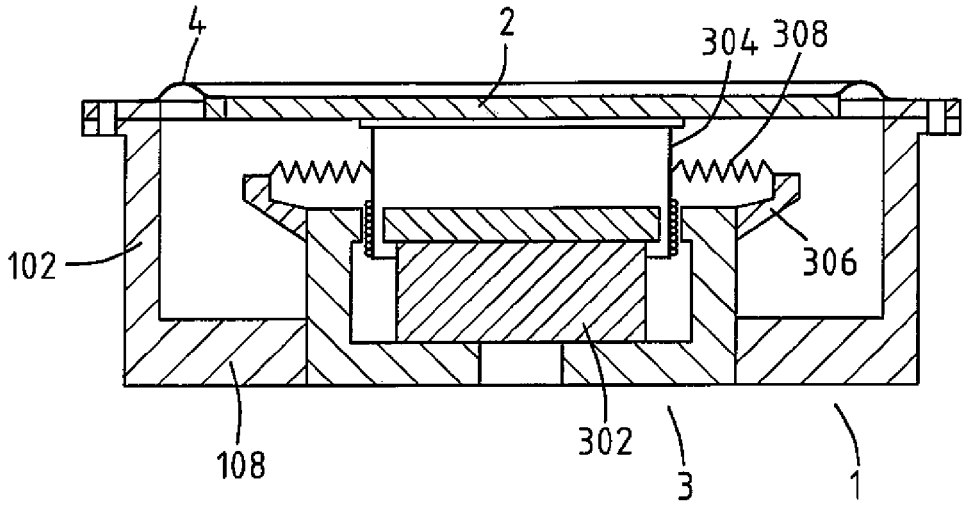
FIG. 2 (PRIOR ART )
FIG. 2 is a cross-sectional diagram showing the inside of the conventional planar speaker of FIG. 1.
Figure 3:
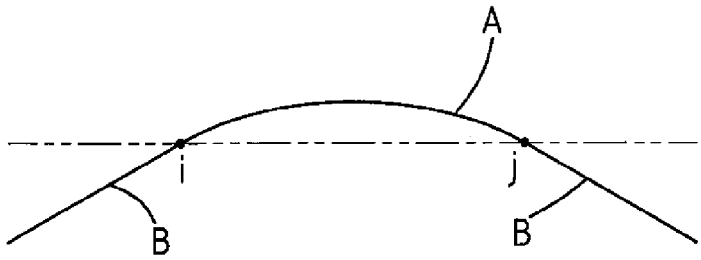
FIG. 3 (PRIOR ART)
FIG. 3 is a schematic diagram showing the diaphragm of a conventional planar speaker undergoing the first symmetric bending mode.
Figure 4:
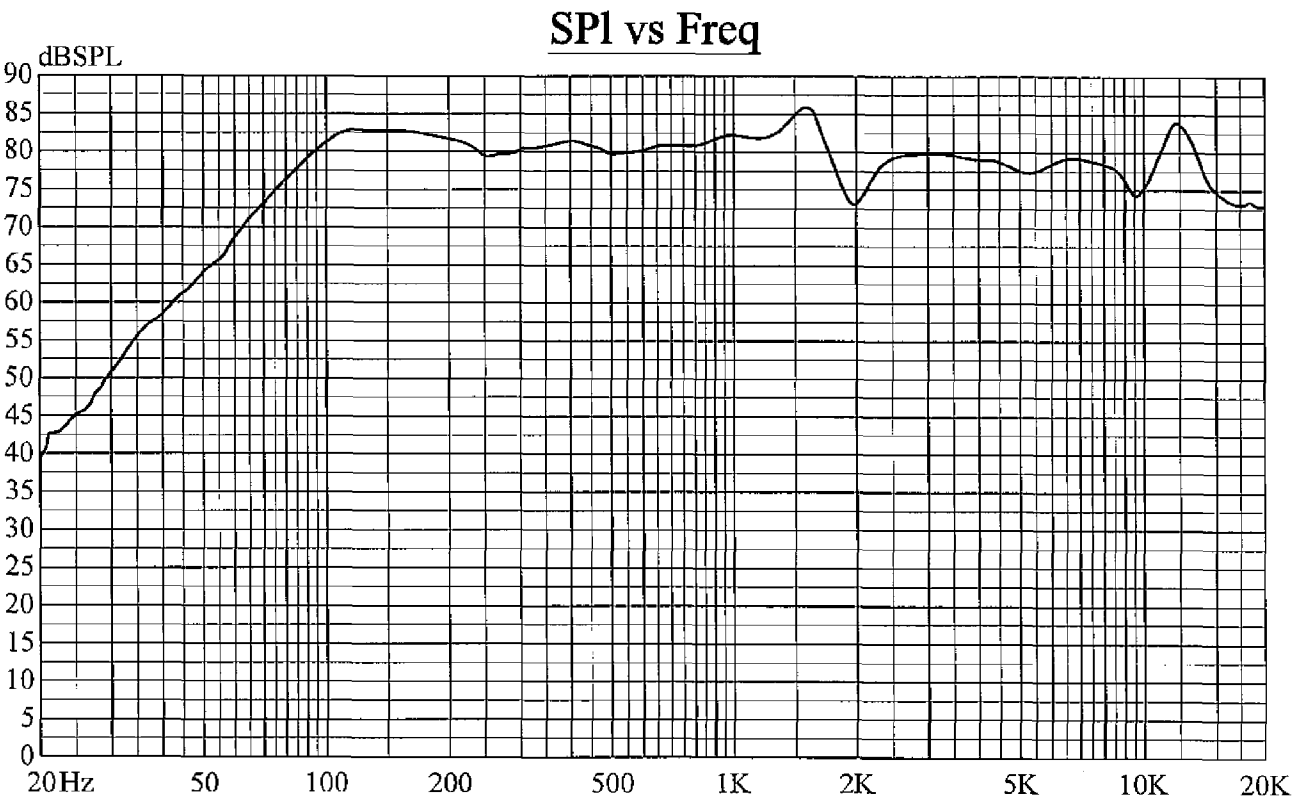
FIG. 4 (PRIOR ART)
FIG. 4 is a frequency response diagram of a conventional planar speaker.
Figure 5:
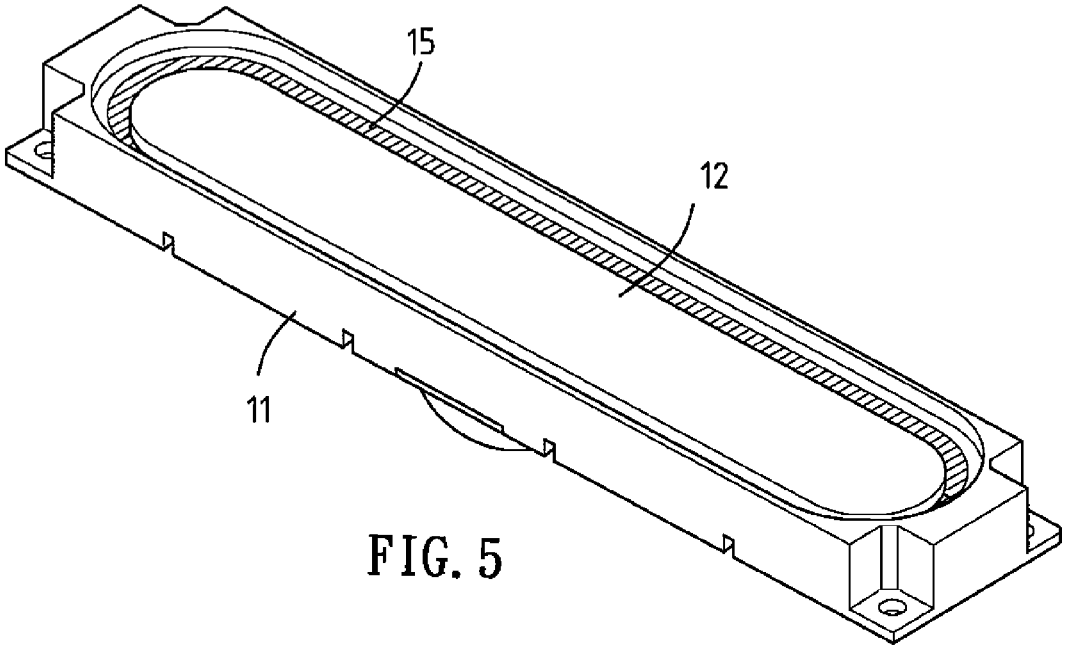
FIG. 5 is a perspective diagram showing a planar speaker according to a first embodiment of the present invention.
Figure 6:
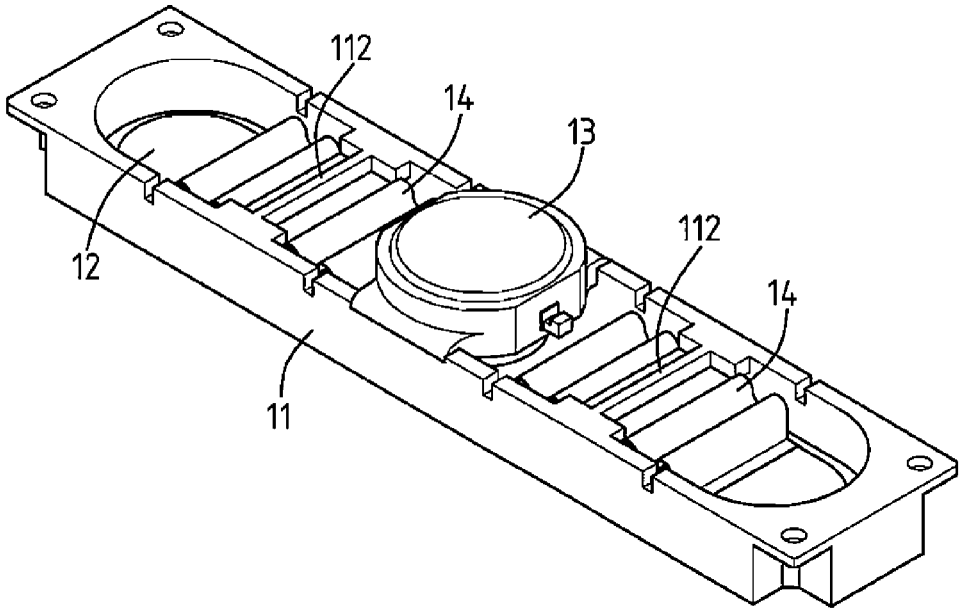
FIG. 6 is a perspective diagram showing the back of the planar speaker of FIG. 5.
Figure 7A:
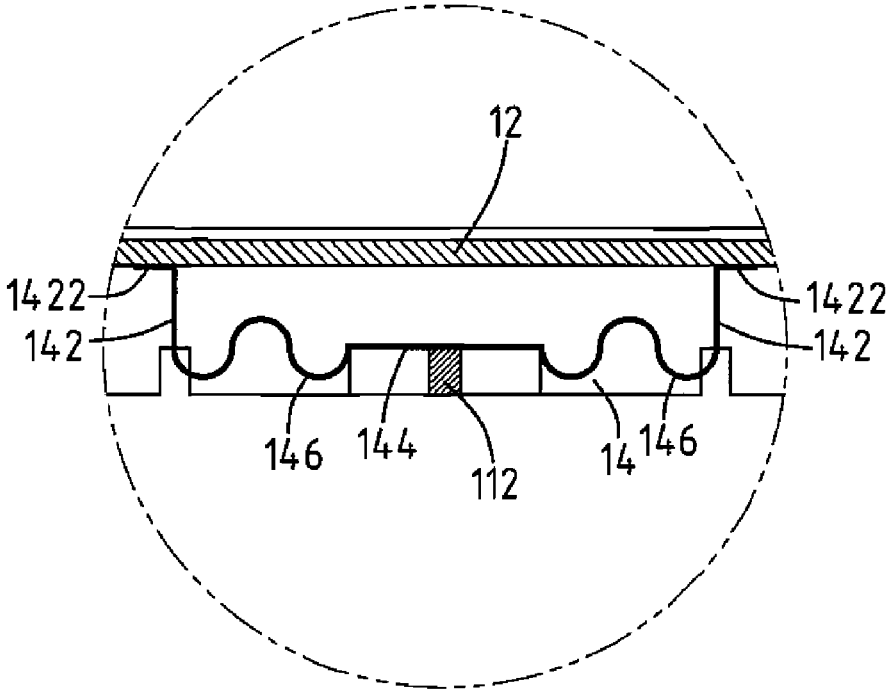
FIG. 7A is a schematic diagram showing the details of a suspension element of the planar speaker of FIGS. 5 and 6.
Figure 7:
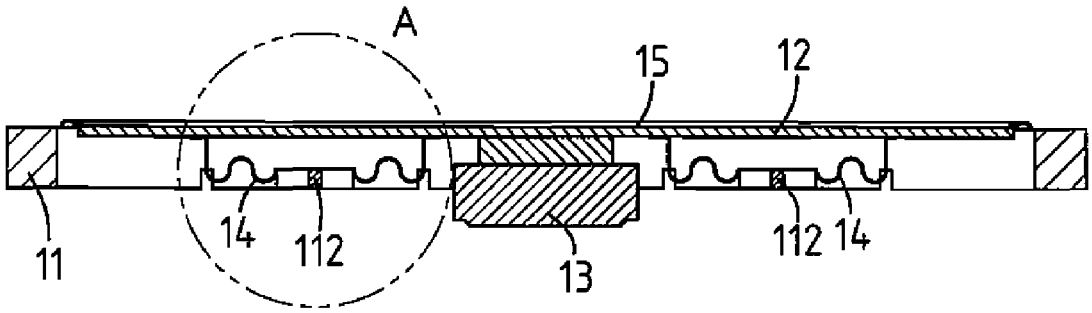
FIG. 7 is a sectional diagram showing the planar speaker of FIGS. 5 and 6.

As shown in FIGS. 5, 6, and 7, a planar speaker according to a first embodiment of the present invention mainly contains a frame 11, a diaphragm 12, a driver 13, two suspension elements 14, and a surround 15. The frame 11 has a flat rectangular shape and the surround 15 is positioned between the circumference of a front opening of the frame 11 and the edge of the diaphragm 12. The diaphragm 12 is thereby suspended in the front opening of the frame 11 by the surround 15. The surround 15, on one hand, suppresses the vibration of the diaphragm 12 at its edge and, on the other hand, prevents the sound waves at either side of the diaphragm 12 from interfering with each other. The driver 13 is positioned in the center of the frame 11 behind the diaphragm 12. A voice coil of driver 13 is attached to a back surface of the diaphragm 12 so that a back-and-forth movement of the coil would cause the diaphragm 12 to vibrate and to produce sound waves.

Figure 8:
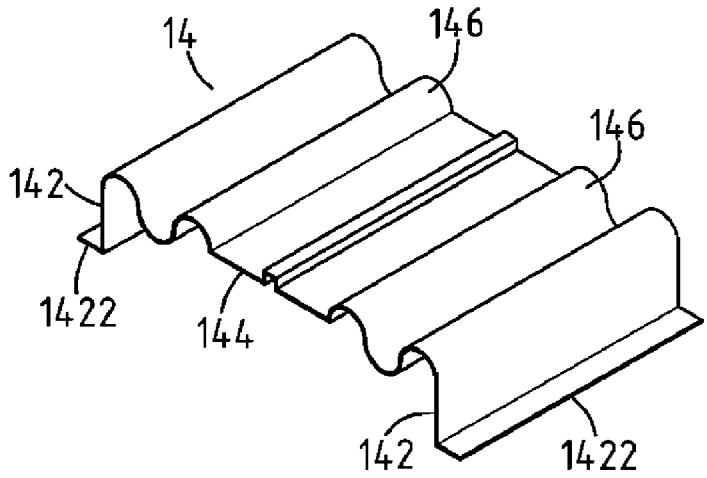
FIG. 8 is a perspective diagram showing a suspension element of the planar speaker of FIGS. 5 and 6.

Two beams 112 are arranged in parallel along a back opening of the frame 11. More specifically, the two beams 112 are positioned between two opposing longer wall segments of the frame 11 and at either side of the driver 13. The suspension elements 14 are made of a flexible material such as foam, rubber, plastic, or a composite material. As further illustrated in FIG. 8, each suspension element 14 contains two vertical arm segments 142, a lateral bridge segment 144, and two vibration segments 146, integrally formed together. The two arm segments 142 are at two opposing sides of the suspension element 14. The bridge segment 144 is in the middle and the two vibration segments 146, on the other hand, are positioned between the bridge segment 144 and a back end of the two arm segments 142, respectively. Each vibration segment 146 contains a plurality of arcs end-to-end connected into a wave-like shape. A front end of each arm segment 142 is bended to form a lateral support 1422. The two lateral supports 1422 are attached to a back surface of the diaphragm 12 and the bridge segment 144 is attached to a front side of a beam 112. In other words, a beam 112 supports a suspension element 14, which in turn supports a portion of the diaphragm 12.

From the diaphragm 12's point of view, it is joined to the frame 11 by the surround 15 at the edge and, on the other hand, by the balanced support of the suspension elements 14 at the back. As the use of a spider is omitted, the diameter of the driver 13 could be preserved or even enlarged. As such, larger amount of air could be driven so as to achieve higher sound pressure and, thereby, superior sound production efficiency. Most importantly, along the longer side of the elongated diaphragm 12, the two portions of the diaphragm 12 at the two sides of the driver 13 are attached to the beams 112 via the suspension elements 14, respectively. Due to the flexibility of the vibration segments 146, the suspension elements 14 could vibrate along with the diaphragm 12. On the other hand, as the suspension elements 14 are positioned symmetrically at the lateral sides of the two cross-over points of the diaphragm 12's first symmetric bending mode, the flexible deformation of the diaphragm 12 along its longer axis is constrained by the suspension elements 14. In other words, the deflections of the areas at the two ends of the diaphragm 12, which vibrates at a phase opposite to that of the center of the diaphragm 12, would be reduced. As such, the frequency response of a planar speaker according to the present invention wouldn't suffer a sharp drop in the middle-frequency range. The planar speaker of the present invention therefore provides superior sound quality.

Figure 9:
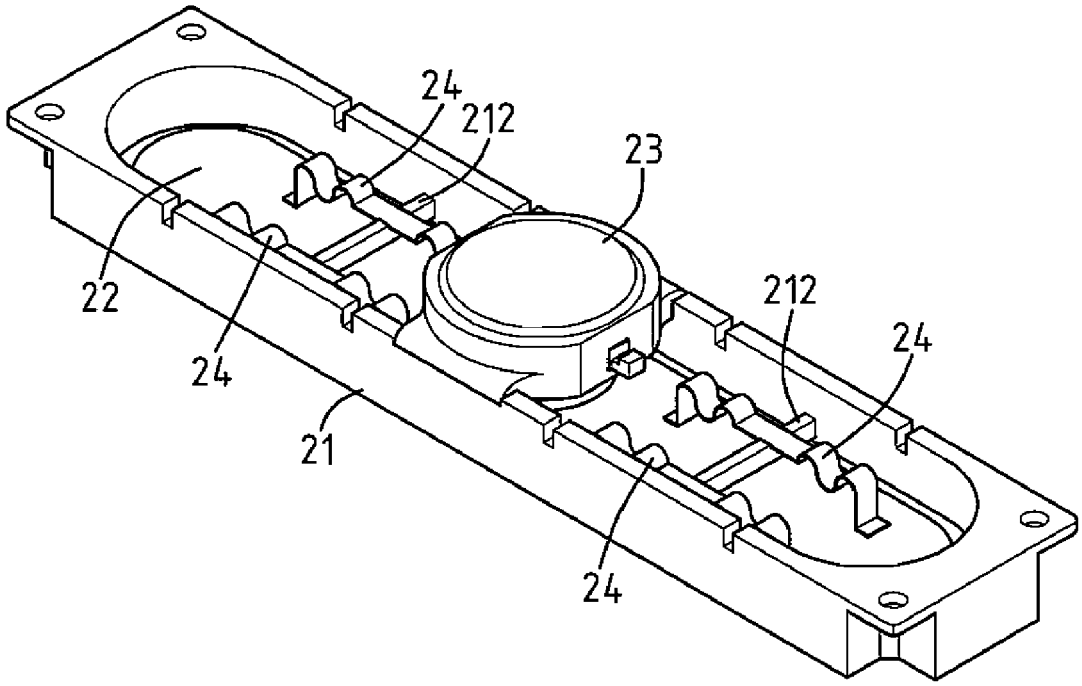
FIG. 9 is a perspective diagram showing the back of a planar speaker according to a second embodiment of the present invention.
Figure 10:
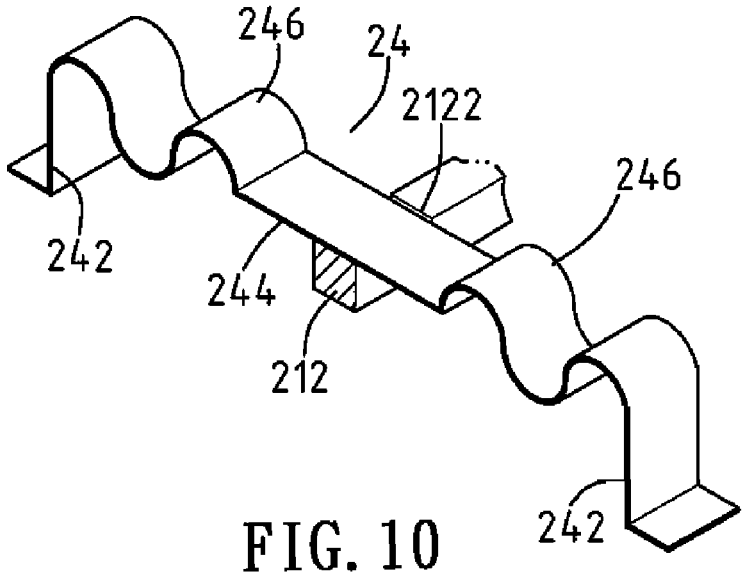
FIG. 10 is a perspective diagram showing a suspension element of the planar speaker of FIG. 9.

The foregoing first embodiment could be extended into a second embodiment as shown in FIGS. 9 and 10. For simplicity, those details identical to the first embodiment are omitted here. As illustrated, the planar speaker, similar to the previous embodiment, also contains a frame 21, a diaphragm 22, a driver 23, and a surround (not shown). The present embodiment, however, contains four, instead of two, narrower suspension elements 24, each of which also contains two arm segments 242, a bridge segment 244, and two vibration segments 246 integrally formed together. Two beams 212 are arranged in parallel at either side of the driver 23 between two opposing longer side walls and between the front and back openings of the frame 11. Along a back side of each beam 212, there is a notch 2122. The bridge segment 244 of each suspension element 24, instead of being attached to a front side of a beam 212, is embedded in the notch 2122 of a beam 212. Please note that, again, the locations where the suspension elements 24 are attached to the diaphragm 22 are symmetrically positioned at the lateral sides of the two cross-over points of the diaphragm 22's first symmetric bending mode.

Figure 11:
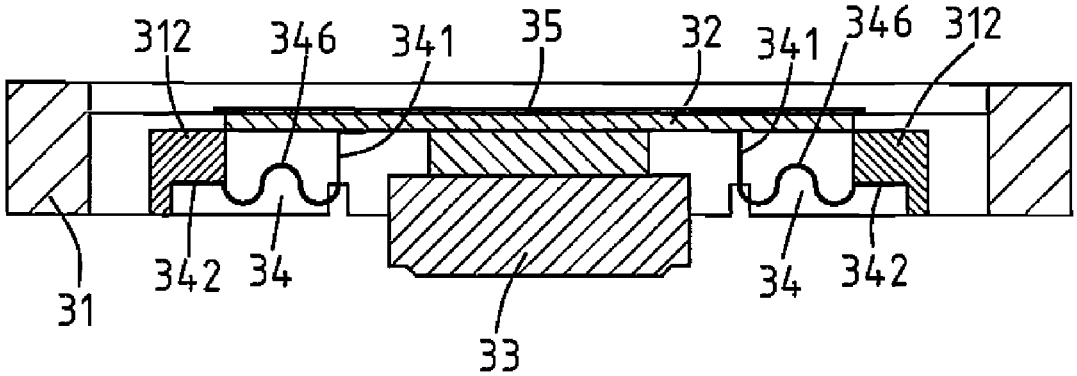
FIG. 11 is a sectional diagram showing a planar speaker according a third embodiment of the present invention.
Figure 12:
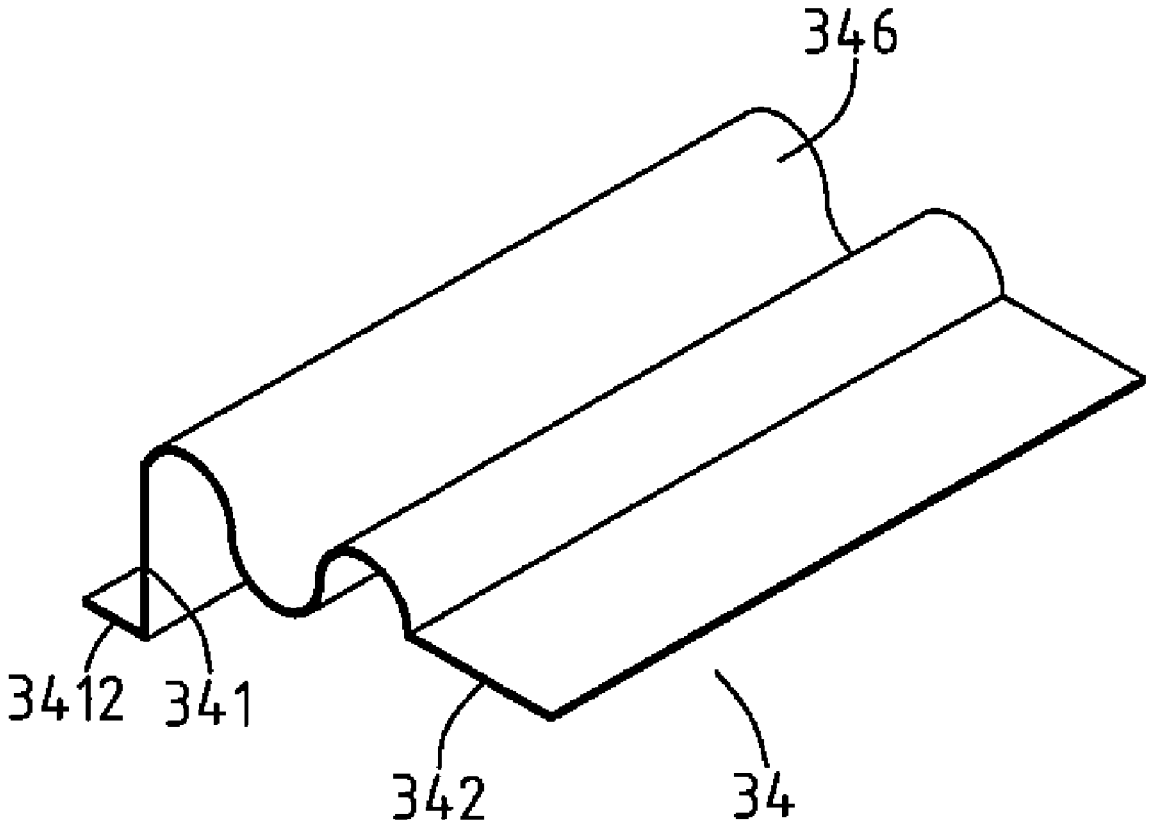
FIG. 12 is a perspective diagram showing a suspension element of the planar speaker of FIG. 11.

A third embodiment of the present invention is shown in FIGS. 11 and 12. As illustrated, the planar speaker, similar to the previous embodiment, also contains a frame 31, a diaphragm 32, a driver 33, two suspension elements 34, and a surround 35. The frame 31 has a flat rectangular shape and the diaphragm 32 is suspended in a front opening of the frame 31 by the surround 35. The driver 33 is positioned in the center of the frame 31 behind the diaphragm 32. A voice coil of driver 33 is attached to a back surface of the diaphragm 32 so that a back-and-forth movement of the coil would cause the diaphragm 32 to vibrate and to produce sound waves.

Two beams 312 are arranged in parallel on either side of the driver 33 between two opposing longer side walls of the frame 31 and behind the diaphragm 32. The suspension elements 34 are made of a flexible material such as foam, rubber, plastic, or a composite material. Each suspension element 34 contains a vertical first arm segment 341, a lateral second arm segment 342, and a vibration segment 346, integrally formed together. The two arm segments 341 and 342 are at two opposing sides of the suspension element 34. The vibration segment 346 is positioned between a back end of the first arm segment 341 and a lateral end of the second arm segment 342. The vibration segment 346 contains a plurality of arcs end-to-end connected into a wave-like shape. A front end of the first arm segment 341 is bended to form a lateral support 3412, which is attached to a back surface of the diaphragm 32. The second arm segment 342 is attached to a back side of a beam 312. In other words, a beam 112 supports a suspension element 14, which in turn supports a portion of the diaphragm 12. Again, the locations where the suspension elements 34 are attached to the diaphragm 32 are positioned on the lateral sides of the two cross-over points of the diaphragm 32's first symmetric bending mode, respectively.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A planar speaker, comprising:

a rectangular frame having a front opening and a back opening;

a diaphragm;

a flexible surround positioned between the circumference of said front opening of said frame and the edge of said diaphragm so that said diaphragm is suspended in said front opening;

a moving-coil driver positioned in said frame and behind said diaphragm, a voice coil of said driver attached to a back surface of said diaphragm so that a back-and-forth movement of said voice coil causes said diaphragm to vibrate;

two beams arranged in parallel between two opposing longer wall segments of said frame, behind said diaphragm, and on either side of said driver; and a plurality of suspension elements made of a flexible material, each suspension element having two vertical arm segments at two opposing sides, a lateral bridge element, and two vibration segments positioned between a back end of said arm segments and said bridge segment, respectively, integrally formed together, each vibration segment having a plurality of arcs end-to-end connected into a wave-like shape so as to achieve flexibility, said arm segments attached to a back surface of said diaphragm, said bridge segment attached to a beam so as to constrain a flexible deformation of said diaphragm along said diaphragm's longer side.

2. The planar speaker according to claim 1, wherein a front end of each arm segment of said suspension element is bended to form a lateral support, and said lateral supports are attached to said back surface of said diaphragm.

3. The planar speaker according to claim 2, wherein the locations where said lateral supports are attached to said diaphragm are positioned symmetrically on the lateral sides of the two cross-over points of the first symmetric bending mode of said diaphragm along said diaphragm's longer side so as to prevent the two end zones of said diaphragm from entering into an out-of-phase vibration against the center of said diaphragm.

4. The planar speaker according to claim 1, wherein said bridge segments of said suspension elements are attached to a front side of said beams, respectively.

5. The planar speaker according to claim 1, wherein said bridge segments of said suspension elements are attached to a back side of said beams, respectively.

6. The planar speaker according to claim 5, wherein each beam has a notch on said back side; and said bridge segments are embedded in said notches of said beams, respectively.

7. A planar speaker, comprising:

a rectangular frame having a front opening and a back opening;

a diaphragm;

a flexible surround positioned between the circumference of said front opening of said frame and the edge of said diaphragm so that said diaphragm is suspended in said front opening;

a moving-coil driver positioned in said frame and behind said diaphragm, a voice coil of said driver attached to a back surface of said diaphragm so that a back-and-forth movement of said voice coil causes said diaphragm to vibrate;

two beams arranged in parallel between two opposing longer wall segments of said frame, behind said diaphragm, and on either side of said driver; and a plurality of suspension elements made of a flexible material, each suspension element having a vertical first arm segments, a lateral second arm element, and a vibration segment positioned between a back end of said first arm segment and a lateral end of said second arm segment, respectively, integrally formed together, each vibration segment having a plurality of arcs end-to-end connected into a wave-like shape so as to achieve flexibility, said first arm segment attached to a back surface of said diaphragm, said second arm segment attached to a beam so as to constrain a flexible deformation of said diaphragm along said diaphragm's longer side.

8. The planar speaker according to claim 7, wherein a front end of said first arm segment of said suspension element is bended to form a lateral support, and said lateral support is attached to said back surface of said diaphragm.

9. The planar speaker according to claim 8, wherein the locations where said lateral supports are attached to said diaphragm are positioned symmetrically on the lateral sides of the two cross-over points of the first symmetric bending mode of said diaphragm along said diaphragm's longer side so as to prevent the two end zones of said diaphragm from entering into an out-of-phase vibration against the center of said diaphragm.

* * * * *